US005979780A

United States Patent [19]

Malone et al.

[11] Patent Number: 5,979,780

[45] Date of Patent: Nov. 9, 1999

[54] THERMOSTATIC EXPANSION VALVE WITH INTEGRAL ELECTRICALLY OPERATED INLET VALVE

[75] Inventors: Peter J. Malone, Des Plaines, Ill.; William N. Eybergen, Windsor, Canada

[73] Assignee: Eaton Corporation, Cleveland, Ohio

[21] Appl. No.: 08/943,400

[22] Filed: Oct. 3, 1997

[51] Int. Cl.[6] ..... F25B 41/04

[52] U.S. Cl. ..... 236/92 B; 62/225

[58] Field of Search ..... 62/225; 236/92 B; 137/614

[56] References Cited

U.S. PATENT DOCUMENTS

| | | | |
|---|---|---|---|
| 4,646,532 | 3/1987 | Nose | 62/212 |
| 4,926,652 | 5/1990 | Kitamoto | 62/225 |
| 5,588,590 | 12/1996 | Sakakibara et al. | 62/225 |
| 5,826,438 | 10/1998 | Ohishi et al. | 236/92 B |

FOREIGN PATENT DOCUMENTS

| | | |
|---|---|---|
| 0 664 425 A1 | 7/1995 | European Pat. Off. . |
| 62-041481 | 2/1987 | Japan . |
| 62-41481 | 2/1987 | Japan . |
| 08210733 | 8/1996 | Japan . |

*Primary Examiner*—William E. Tapolcai
*Attorney, Agent, or Firm*—Roger A. Johnston

[57] ABSTRACT

A mechanical thermostatic refrigerant expansion valve assembly with an electrically operated shut-off in the inlet to the valve body. Preferably, the electrical operator is a solenoid attached to the valve body on the end opposite the mechanical thermal responsive valve actuator so as to minimize the changes in the manufacturing of an existing valve body. The solenoid armature moves a secondary valving member spring biased to shut off flow in the valve inlet.

10 Claims, 1 Drawing Sheet

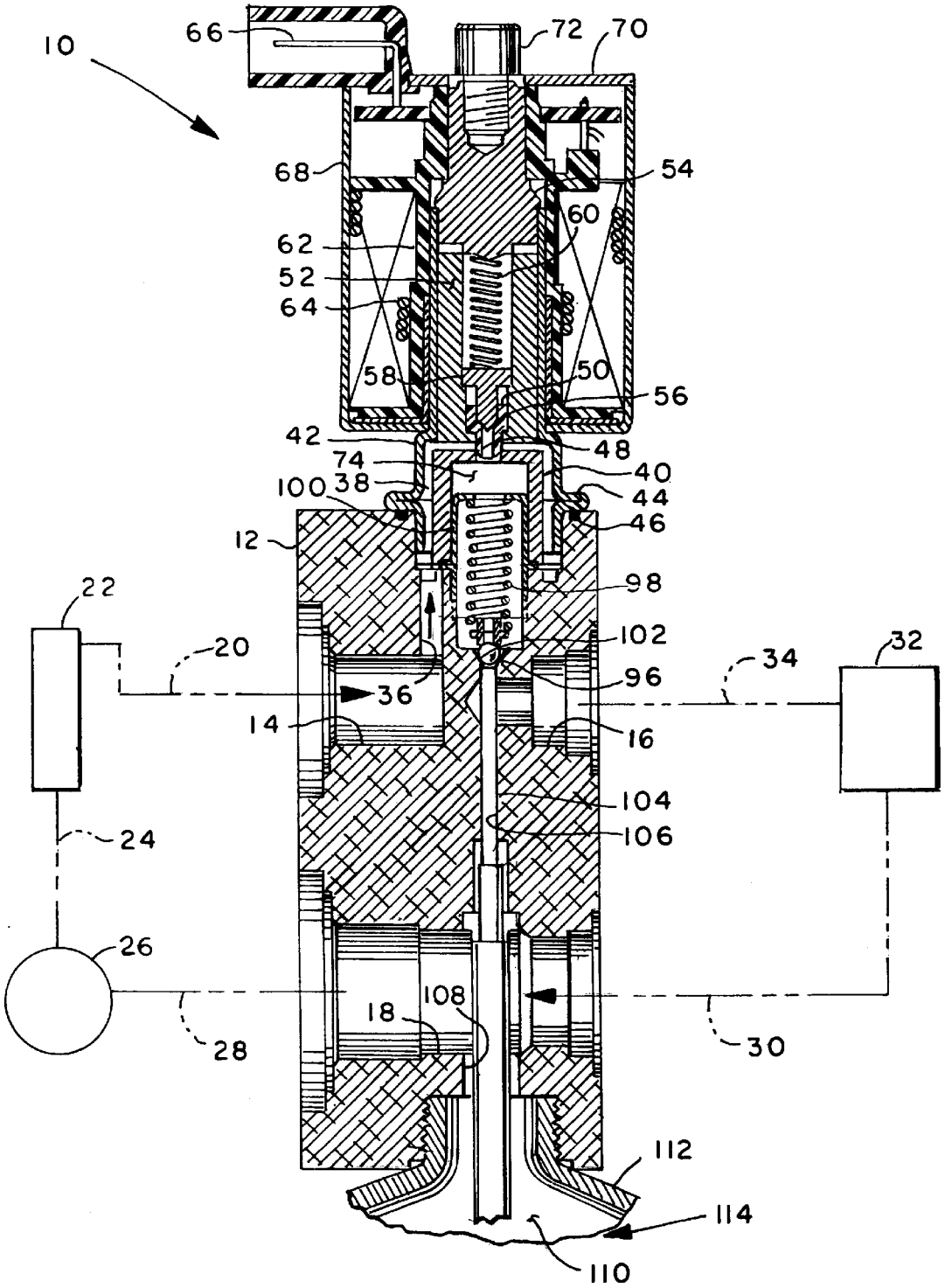
10
66
72
70
68
54
60
62
52
64
58
50
56
42
48
74
40
100
38
44
46
12
98
22
102
20
34
32
36
96
14
16
104
24
106
26
108
18
28
30
112
114
110

THERMOSTATIC EXPANSION VALVE WITH INTEGRAL ELECTRICALLY OPERATED INLET VALVE

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to thermally responsive or thermostatically operated valves and particularly relates to thermostatically operated expansion valves of the type employed for controlling flow of refrigerant in an air conditioning or refrigeration system. In air conditioning systems employed for passenger compartment cooling of motor vehicles, it is known to employ an expansion valve for controlling refrigerant flow from the high pressure side of the compressor through the condenser to the evaporator by utilizing a valve which is moved by the force of expansion of fluid in a closed chamber which senses the temperature of the flow discharging from the evaporator. Such valves are referred to as thermostatic expansion valves and have found widespread use in automotive air conditioning systems.

Currently, it is becoming increasingly popular to provide dual evaporators in a single automotive air conditioning system such as one for front seat passengers and another for rear seat passengers; or, alternatively separate evaporators for cooling left and right seat row positions such as for the driver and front seat passenger. Where dual evaporators are employed, it has been desired to provide a way or means of shutting off one of the evaporators remotely with an electrically operated device without incurring the cost penalty of providing separate electrically controlled shut off valves in the refrigerant line to the evaporators.

The thermostatically controlled mechanical expansion valves presently employed in automotive air conditioning systems have experienced widespread usage because of their low cost and simplicity of construction. However, thermostatically controlled expansion valves are only able to react to temperature changes in the flow of refrigerant discharging from the evaporator; and, there is no way to provide external user control of the valve once it has been calibrated and installed in the system. It has been desired to provide remote electrical control of the vehicle air conditioning system to provide the user with a greater degree or level of control and to not rely only on the ability of the thermostatic expansion valve to provide proper control by reacting to evaporator discharge temperature.

Furthermore, it has been desired to provide for electrical control of refrigerant flow in a refrigeration or air conditioning system which enables the use of a microcomputer to employ selected algorithms to provide control of refrigerant flow in a manner providing improved cooling control.

Thus, it has been desired to provide a way or means of remotely electrically controlling the flow of refrigerant to plural evaporators in a vehicle air conditioning system. It has further been desired to provide for remotely shutting off the flow of refrigerant to one of a plurality of evaporators in a vehicle air conditioning system in a manner which is sufficiently low in cost to render the system cost effective in the high volume motor vehicle marketplace.

BRIEF SUMMARY OF THE INVENTION

It is an object of the present invention to provide for remotely shutting off the flow of refrigerant to an evaporator of a refrigeration system.

It is a further object of the present invention to provide for remotely electrically shutting off the flow of refrigerant to the inlet of a refrigerant expansion valve.

It is another object of the present invention to provide for remotely controlling an electrically operated shut off in the inlet of a thermostatically operated refrigerant expansion valve.

It is another object of the present invention to provide a solenoid operated valve in the inlet upstream of the thermostatically controlled valve member in a refrigerant expansion valve.

The present invention provides a thermally responsive mechanical expansion valve for controlling flow of refrigerant from the compressor discharge side to the evaporator in a cooling system. The invention provides for the addition of an electrically operated valve member in the inlet passage of a thermostatic mechanical expansion block valve to permit shut off of refrigerant flow to the thermostatically operated expansion valve member. In the preferred practice, the electric operator is an electromagnetic solenoid which is attached to the end of the block valve opposite the fluid pressure capsule typically provided for thermostatic operation of the expansion valve member. The present invention thus provides for a simple modification or adaptation of an existing thermostatically operated mechanical expansion valve for controlling refrigerant flow to an evaporator in a manner which enables remote electrical shut off of the expansion valve at its inlet without the necessity of costly changes in the manufacturing of the expansion valve which would require expensive production tooling changes. The ability to provide remote electrically operated shut off of a thermostatically operated refrigerant expansion valve is particularly suitable for systems employing plural evaporators inasmuch as the user may conveniently remotely shut off the refrigerant flow to any of the evaporators as desired.

BRIEF DESCRIPTION OF THE DRAWINGS

The sole drawing of the invention is a cross-sectional view of the valve assembly of the present invention.

DETAILED DESCRIPTION OF THE INVENTION

Referring to the drawing, the valve assembly is indicated generally at 10 and includes a valve body or block 12 having formed therein a high pressure inlet passage 14 and a reduced pressure outlet passage 16 and a flow through sensing passage 18.

It will be understood that upon installation of valve 10 in a refrigeration system, inlet passage 14 is connectable via a conduit 20, indicated in dashed outline, communicating with the outlet of a condenser 22 having its inlet connected via a conduit 24, shown in dashed outline, to the discharge or outlet of a compressor 26. The inlet of the compressor is connectable via a conduit 28, shown in dashed outline, communicating with passage 18. The inlet end of passage 18 is connectable via a conduit 30, shown in dashed outline, communicating with the discharge outlet of an evaporator 32. The inlet of the evaporator is connected via conduit 34, shown in dashed outline, to the valve outlet passage 16.

The inlet passage 14 of valve assembly 10 communicates with a transfer passage 36 formed in the body 12 which transfer passage communicates with an annular region 38 formed between an inverted cup-shaped valve member 40 and a tubular cover or guide member 42 received in a recess formed in the upper end of the valve body 12. The end of the tubular member 42 is preferably threadedly engaged in the valve body for retention therein. Tubular member 42 has a convolution 44 formed thereon, the lower surface of which seals against a resilient seal ring 46 disposed on the upper surface of the body 12. Valve member 40 has a valve seat 48 formed in the closed end thereof and which is disposed for contact by a resilient obturator or valving member 50. Resilient valving member 50 is biased downwardly against a shoulder 56 formed in a slidably moveable armature 52 by a plunger or pressure relief member 58 which closes a center hole in valve member 50 and which is in turn biased downwardly by the lower end of spring 60 having its upper end registered against pole piece 54. The spring 60 thus biases the valve member 50 and the armature 52 in a downward direction such that the valve member 50 is seated on valve seat 48.

The tubular member 42, which functions as a guide for moveable armature 52, has received thereover a bobbin 62 which has wound thereon a coil of conductive material 64 which terminates in a pair of electrical connector terminals one of which is illustrated and denoted by reference numeral 66 and which is adapted for external electrical connection thereto. The coil 64 and bobbin 62 are surrounded by a ferromagnetic canister 68 or cover which completes the flux loop about the coil in cooperation with a flux collecting retaining washer 70 which is secured onto pole piece 54 by suitable fastening means such as screw 72.

In operation, valve 50 is normally in the closed position, as is the pressure relief member 58. Upon energization of the coil 64, the force of magnetic attraction moves armature 52 toward the pole piece 54 causing valve member 50 to be lifted from valve seat 48 permitting flow to the interior chamber 74 of the member 40.

Chamber 74 communicates with a valve member in the form of ball 96 which is biased by spring 98 retained by a cup 100 nested in cup 40 in the valve body. The ball valve member 96 is biased against a valve seat 102 formed in the body 12 and valve seat 102 communicates with the outlet passage 16.

An operating rod 104 is slidably guided in the body in a bore 106; and, the rod 104 extends through sensing passage 18 and aperture 108 and outwardly of the body into chamber 110 of the thermally responsive actuator indicated generally at 114 within capsule 112. The rod is actuated by a diaphragm (not shown) which forms a part of actuator 114. Capsule 112 threadedly engages the end of the valve body adjacent passage 18 and is thus attached thereto, in a manner known in the art.

In operation, thermally responsive actuator 114 effects movement of the rod 104 to cause opening of valve 96 from the valve seat 102 to permit flow to passage 16 in a manner well known in the art.

The present invention thus provides for a remotely controlled shut off of the flow in the inlet of a thermostatically operated expansion valve and has particular application to thermostatically operated expansion valves employed for controlling the flow of refrigerant in a refrigeration or air conditioning system.

The valve assembly of the present invention may be made by modifying an existing thermo expansion valve of the type manufactured for controlling refrigerant flow in automotive air conditioning systems to include a solenoid attached to the valve block on the end opposite the thermally responsive operator for controlling movement of the expansion valve member within the block. A similar modification may be made to a thermostatically operated expansion valve having its inlet and outlet disposed at right angles in the valve body by providing an opening in the valve body and attaching a solenoid operator and valve with the armature aligned with the valve operating rod.

Although the present invention has been described hereinabove with respect to the illustrated embodiments, it will be understood that the invention is capable of modification and variation and is limited only by the scope of the following claims.

We claim:

1. A thermostatic expansion valve assembly with integral electrically operated inlet shut-off for use in controlling refrigerant flow, said valve assembly comprising:

(a) structure for defining a valve body having a high pressure inlet passage, a first annular valve seat in said inlet passage and an outlet passage communicating with said valve seat and a sensing passage;

(b) a first valve obturator moveable between a position opening and a position closing said first valve seat;

(c) thermally responsive means, including an actuator member, operative in response to temperature changes of flow in said sensing passage to move said first obturator between said first and second positions;

(d) a second annular valve seat disposed in said inlet passage upstream of and communicating with said first annular valve seat, and a second obturator moveable from a position opening and a position closing said second valve seat and blocking flow to said first valve seat; and, (e) an electrically actuated device operable upon energization to move said second obturator to said opening position, said electrically actuated device and said second obturator being disposed at one end of said body adjacent said high pressure inlet passage, said high pressure inlet passage communicating with an annular region, a cup-shaped member disposed in said annular region, said second valve seat being formed in said cup-shaped member.

2. The assembly defined in claim 1, wherein said electrically operated device includes an electromagnetic operator.

3. The assembly defined in claim 1, wherein said electrically operated device includes means biasing said first and second obturators to the closed position.

4. The assembly defined in claim 1, wherein said electrically actuated device includes a solenoid coil with moveable armature, wherein said armature movement is aligned with movement of said thermally responsive means actuator.

5. The assembly defined in claim 1, wherein said electrically actuated device is disposed externally of said valve body.

6. The assembly defined in claim 1, wherein said thermally responsive means is disposed on one end of said body and said electrically actuated device is disposed on an end of said body opposite said one end.

7. A method of electrically controlling a supply of refrigerant to a thermostatic expansion valve having a high pressure inlet, a reduced pressure outlet and a valve member moved with respect to a valving port by a thermally responsive actuator for controlling flow from the inlet to outlet comprising:

(a) disposing a moveable obturator in the inlet upstream of the moveable valve member;

(b) disposing an electrically actuated operator on the valve and energizing the operator and moving the obturator and opening the refrigerant supply to said valve member;

(c) disposing a cup-shaped member in an annular region at one end of the body and cummincating with annumar region with said high pressure inlet; and (d) forming a valve seat in said cup-shaped member for said obturator.

8. The method defined in claim 7, wherein said step of energizing the operator includes electromagnetically moving said obturator.

9. The method defined in claim 7 wherein said step of disposing a moveable operator includes biasing said operator to the closed position.

10. The method defined in claim 7, wherein said step of disposing an electrically actuated operator includes attaching the operator to a valve body on an end remote from said thermally responsive actuator.

* * * * *